US007870683B2

(12) United States Patent
Waid, Jr.

(10) Patent No.: US 7,870,683 B2
(45) Date of Patent: Jan. 18, 2011

(54) METHOD OF TRENCHING BELOW THE WATER TABLE

(75) Inventor: Everett Leslie Waid, Jr., Leander, TX (US)

(73) Assignee: H.L. Chapman Pipeline Construction, Inc., Houston, TX (US)

( * ) Notice: Subject to any disclaimer, the term of this patent is extended or adjusted under 35 U.S.C. 154(b) by 115 days.

(21) Appl. No.: 12/199,247

(22) Filed: Aug. 27, 2008

(65) Prior Publication Data

US 2010/0050482 A1 Mar. 4, 2010

(51) Int. Cl.
*E02F 1/00* (2006.01)

(52) U.S. Cl. ..... 37/195; 37/352; 37/142.5

(58) Field of Classification Search ..... 37/347, 37/348, 352, 360, 142.5, 382, 387, 195; 405/149, 405/282

See application file for complete search history.

(56) References Cited

U.S. PATENT DOCUMENTS 1,698,529 A * 1/1929 Bennett ..... 37/195
3,998,065 A * 12/1976 Darnell ..... 405/179
4,542,940 A * 9/1985 Marten ..... 299/1.5
4,662,684 A * 5/1987 Marten ..... 299/1.5
4,714,379 A * 12/1987 Gilchrist, Jr. ..... 405/163
4,741,646 A * 5/1988 Hatch ..... 405/175
4,871,281 A * 10/1989 Justice ..... 405/181
5,242,246 A * 9/1993 Manchak et al. ..... 405/128.85
5,611,643 A * 3/1997 Tallard ..... 405/157
5,685,668 A * 11/1997 Justice ..... 405/267
5,830,752 A * 11/1998 Bruso ..... 435/283.1
6,058,631 A * 5/2000 Crawford ..... 37/349
7,010,873 B2 * 3/2006 Kinoshita et al. ..... 37/352
7,037,040 B2 * 5/2006 Phillips et al. ..... 405/129.6
7,632,039 B2 * 12/2009 Patterson ..... 405/15
2008/0127529 A1 * 6/2008 Stanek et al. ..... 37/348

OTHER PUBLICATIONS http://www.efsec.wa.gov/kittitaswind/Recommendation%20to%20Governor%205-2-07/trenching.pdf RES America, Inc.— Underground Cable Trenches—Construction Practices Aug. 16, 2006 PDF documents—15 pages.*

Construction Equipment, Farm Machinery and Trenching and Trenchless Equipment; www.vermeer.com/TrenchinEquipment/ Model; 2001-2008 Vermeer Corporation.

T1060 Mechanical Drive Chain Trencher; www.trencor.com/www/docs/218.668; 2001-2005 Astec Industries, Inc.

TRS-1000 Chainsaw; www.tesmec.com/machines; Tesmec USA, Inc.

* cited by examiner

*Primary Examiner*—Thomas B Will
*Assistant Examiner*—Jamie L McGowan
(74) *Attorney, Agent, or Firm*—Gunn, Lee & Cave, P.C.

(57) ABSTRACT

A method for trenching below the water table in environmentally sensitive areas such as the Florida Keys is shown. A first pass made by a trencher digs a first trench from the surface to the water table. During the first pass, relatively dry spoil is removed from the first trench. Next, a much deeper second trench is dug below the first trench; however, wet spoil remains in the now combined first and second trench, the combined first and second trench being large enough to accumulate the wet spoil with expansion. Thereafter, the combined first and second trench may be filled with the relatively dry spoil, packed and driven upon. Later, the packed spoil may be removed and water pipes, electric cables, sewer lines or the like buried in the trench. According to the requirements of the work area, the spoil may be used to partially fill the combined first and second trench or be hauled away.

12 Claims, 6 Drawing Sheets

METHOD OF TRENCHING BELOW THE WATER TABLE

1. FIELD OF THE INVENTION

This invention relates generally to a method of trenching and, more particularly, a method of trenching below the water table in a porous formation.

2. BRIEF DESCRIPTION OF THE PRIOR ART

The making of trenches is as old as civilization itself. Canals and aqueducts have been built to move water from one location to another. However, at the beginning of recorded time, such channels or aquaducts were built by hand. Later, domesticated animals were used in some of the digging or trenching.

As the industrial revolution progressed, machines were used to dig or excavate trenches. The machines varied in size from a hand held walk behind machines to large earth moving devices. When encountering rock, in addition to the machines, dynamite and other blasting devices were used to break up the rock. In approximately the 1970s, milling machines with cutting teeth having carbide hardened tips were used to mill away or cut the rock. By this century, the most common way of excavation or cutting new road beds through rocky portions of the earth's crust was the use of rock milling type machines.

Similar types of milling processes were used in the excavation or digging of trenches in rock formation, except the cutting teeth would be on trenching chains rotating around a boom that could be raised and lower. One of the largest manufacturers of trenching equipment is Astec Industries, Inc. which manufactures and sells a line of trenchers under that mark Trencor®. The Trencor® products range from walk behind trenchers, ride on trenchers, track mounted trenchers to road milling equipment.

Another large manufacturer of similar type of trenching equipment is sold under the mark Vermeer®. Again, the various types of trenching equipment sold under the Vermeer® brand range from walk behind trenchers, ride on trenchers, rock wheels, and track trenchers.

More and more trenches are now being excavated or dug in which to bury electrical cables, water pipes, sewer lines and the like. Many times the trenches being dug for public utilities are dug along existing streets or right of ways. If a trench is being dug along an existing street, it is very important there be a minimum amount of interruption with the normal traffic flow, plus a minimum clean up effort afterwards. In some areas, due to environmental constraints, the excavation or digging of the trench cannot interfere with natural habitat in the area. This means waste from the trenching may not wash off, or be disposed of, in the environmentally sensitive area.

A particularly unique environmentally sensitive area in which applicant has worked is the Florida Keys. Typically the surface of the earth is only a few feet above the water table. Because the rock in the Florida Keys is coral that has formed on the ocean floor, it is still porous. Therefore, when trenching below the water table in the porous rock, the material removed (sometimes called "spoil") is very pliable like wet cement due to inflowing water. The wet spoil will spread over everything and is almost impossible to remove. However, in the same area when trenching above the water table, the spoil removed is relatively dry.

The problem with trenching below the water table in the Florida Keys is the wet spoil will inevitably get on everything, and despite the best efforts to clean up, some will remain. The part that remains will wash into the natural habitat surrounding the Florida Keys causing damage to the environment.

Areas other than the Florida Keys that have shallow water tables encounter the same problem of wet spoil when trenching below the water table. The wet spoil flows everywhere and is almost impossible to remove.

3. SUMMARY OF THE INVENTION

It is an object of the present invention to provide a method for trenching below the water table in the earth's surface.

It is yet another object of the present invention to provide for trenching below the water table in the earth's surface, yet maintaining wet spoil in the trench.

It is still another object of the present invention to excavate or dig relatively dry spoil from the earth's surface down to the water table in a first pass and excavate or dig from the water table to the completed depth in a second pass, while maintaining the wet spoil inside the trench during the second pass.

It is yet another object of the present invention to prevent spoil removed from a trench from polluting the environment, especially in areas where trenching occurs below the water table.

In an environmentally sensitive area such as the Florida Keys, a first pass is made with a trencher having a boom with a digging chain thereon. During the first pass, the boom is lowered so that the digging chain excavates or digs the trench to an intermediate depth from the earth's surface to the water table. The relatively dry spoil removed during the first pass can be moved to one side of the intermediate depth trench.

Thereafter, a second pass occurs where the intermediate depth trench is excavated or dug from the water table to a full depth trench in a second pass. During the second pass, wet spoil is dug up, but drops back into the full depth trench and is retained therein. Also, during the second pass, the belts or conveyors are tuned OFF causing the wet spoil to drop back in to the full depth trench.

Because during the first pass, the relatively dry spoil was removed from the intermediate depth trench, during the second pass, even with the expansion of the wet spoil, the full depth trench can accommodate the wet spoil even with its expansion.

In digging the trench, a predetermined line is normally followed as to where the trench will go. The trencher, which is normally a track mounted trencher, follows the predetermined line with the boom and digging chain excavating or digging along the predetermined line in a first direction to excavate from the surface to the water table. However, during the second pass, it can be by either of the following two methods.

In the first method, a second digging machine moves in the same direction with the digging chain reversed and the belts or conveyors turned OFF so that the wet spoil removed when digging from the water table to the full depth will fall back into the full depth trench. The full depth trench has enough space to accommodate the wet spoil even with expansion.

The second method is for the first digging machine after making the first pass along the predetermined line to dig from the earth's surface to the water table, simply operates in reverse, but with the belt and/or conveyors turned OFF and raised, plus the boom lowered, to dig from the water table to the full depth trench. The wet spoil drops back into the full depth trench. Again, the full depth trench can accommodate the wet spoil plus the expansion. The only problem is that in this second method, the digging is on the end of the boom which causes more vibrations back in the trencher than would be caused using the first method.

Also, during the second pass of either method, the speed of the trencher and the digging chain should be slowed down during the second pass (1) to prevent spillage of the wet spoil outside of the completed trench and (2) to provide the best trenching performance.

A third method may be used wherein the first digging machine makes a first pass along the predetermined line, but has the digging chain rotating in a counter clockwise direction so that the upwardly rotating side of digging chain digs on the downward rotation. Some of the loosened spoil will travel up the digging chain onto the belt and be removed to the side of the trench being dug. During the first pass the trench is dug from the surface to the water table.

Thereafter, the same digging machine makes a second pass in the same direction, but (1) with the boom lowered so that the trench is dug from the water table to the full depth and (2) the belt is turned OFF. By turning the belt OFF, the wet spoil will accumulate, ride up the digging chain, but will fall back into the trench. Due to a removal of a portion of the dry spoil when digging from the surface to the water table, the trench now has enough space to accommodate the wet spoil and have room for expansion.

4. BRIEF DESCRIPTION OF THE PRIOR ART

DETAILED DESCRIPTION OF THE PREFERRED EMBODIMENT

Figure 1:
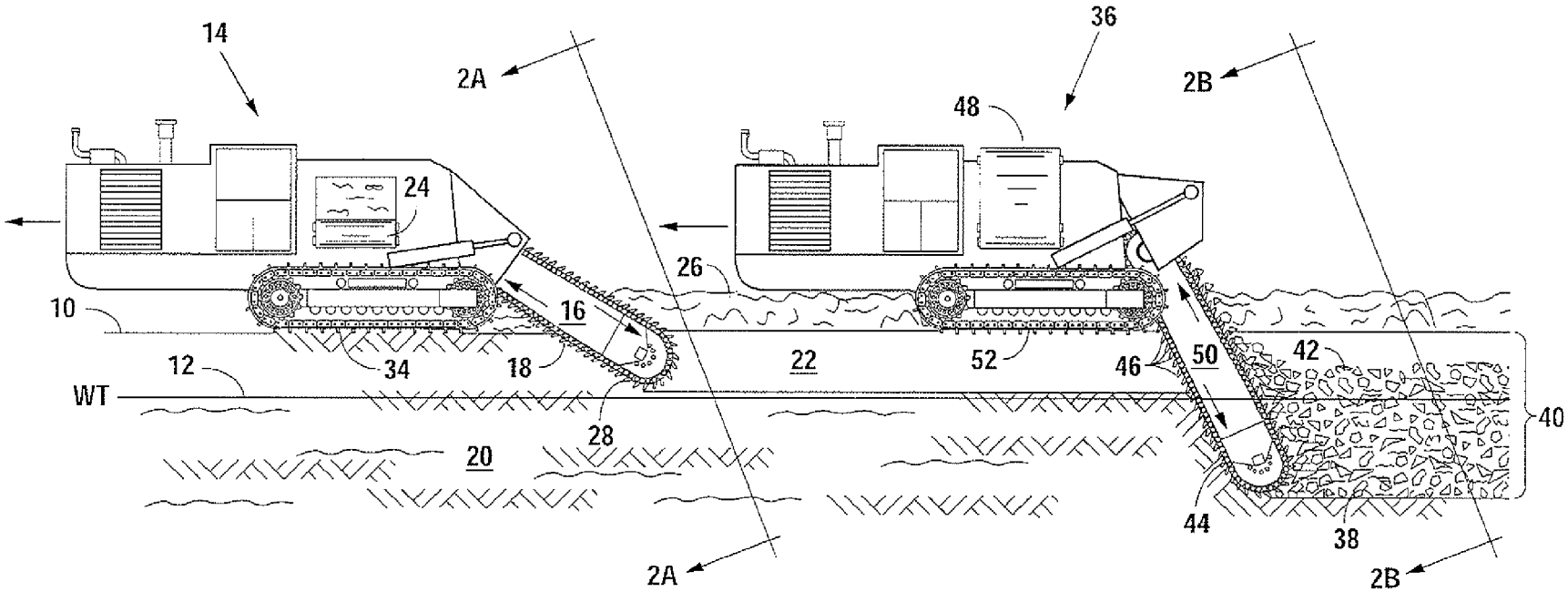
FIG. 1 is a side elevational view of the present method with the earth's crust being cut away to show a trench being dug.

When trenching in an area of South Florida or the Florida Keys, the surface 10 may be only a few feet above the water table 12 as shown in FIG. 1. In the Florida Keys, most of the rock is porous coral rock that allows the water to flow therethrough. Therefore, as the tide of the ocean rises and falls, the water table 12 will rise and fall accordingly. If a hole is dug below the water table 12, it will quickly fill up with water due to the porous nature of the rock.

In the present invention as shown in FIG. 1, a first trencher 14 makes a first pass in the direction indicated along a predetermined line along which a trench is to be dug or excavated. The boom 16 is lowered so that the cutting teeth 18 dig into the earth's crust 20 digging and excavating an intermediate trench 22 from the surface 10 down to approximately the water table 12. The belt 24 is lowered and rotating to remove relatively dry spoil 26 from the intermediate trench 22 to the opposite side of first trencher 14. The belt 24 is rotating so the digging chain 28 rotates in the direction indicated by the arrows, cutting teeth 18 dig into the earth's crust to excavate relatively dry spoil 26 therefrom, which relatively dry spoil 26 will be moved to one side to a wind row 30 (see FIG. 2A). However some of the relatively dry spoil 26 will fall down into mounds 32 on either side of the intermediate trench 22 (see FIG. 2A).

Figure 2A:
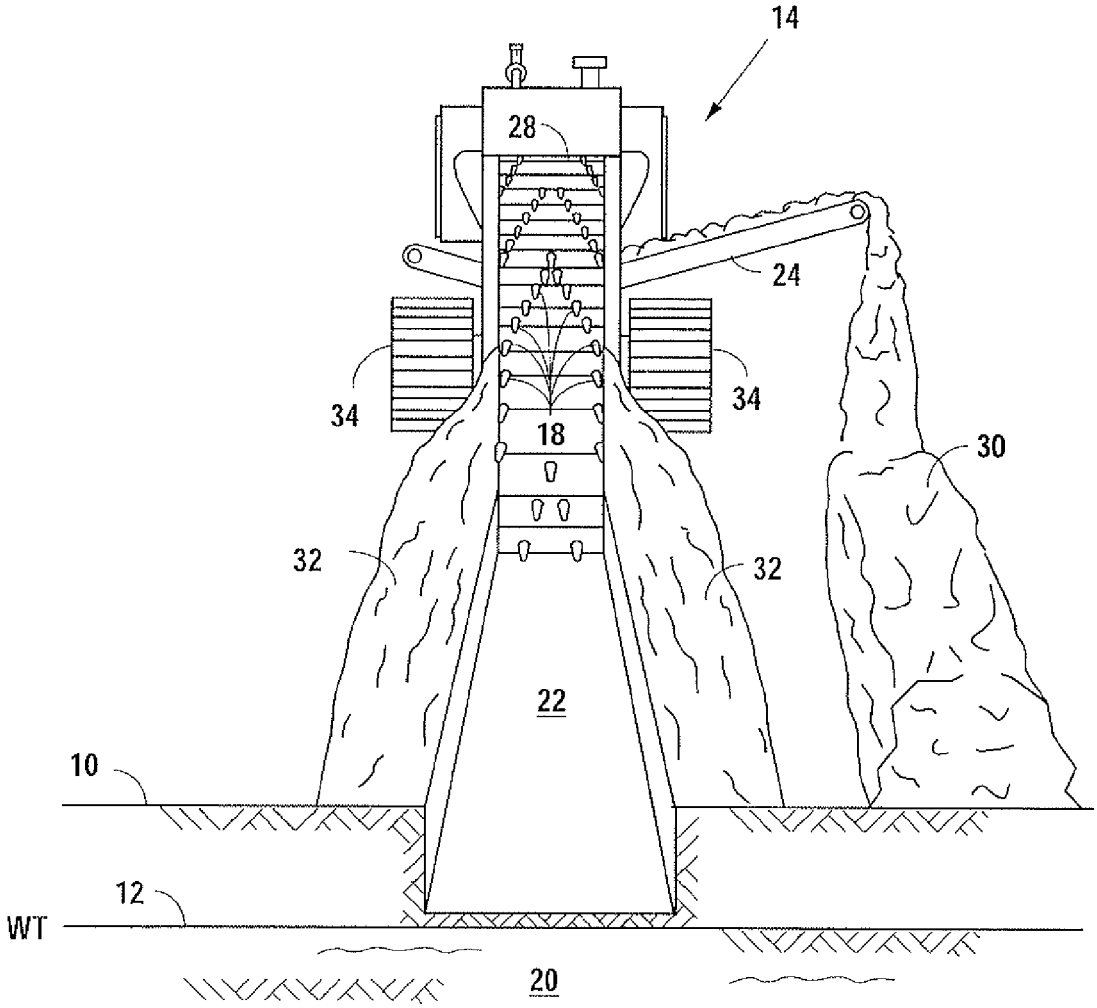
FIG. 2A is a cross-sectional view of FIG. 1 taken along section lines 2A-2A of FIG. 1 illustrating the first pass.

Forward movement of the first trencher 14 is controlled by tracks 34 on either side thereof. The tracks 34 have the proper amount of rotation to maintain the cutting teeth 18 in excavating contact with the earth's crust 20 and to maintain close to optimum cutting conditions for digging the intermediate trench 22. A better view of the cutting chain 28 with the cutting teeth 18 thereon is shown in FIG. 2A. Also, a better illustration of the removal of the relatively dry spoil 26 into wind row 30 and mounds 32 is illustrated.

If the trenching as shown in FIG. 1 is occurring in the Florida Keys, the boom 16 will have to be raised or lowered as the tide comes in or goes out, which tide causes the water table 12 to fluctuate accordingly. In other words, according to the time of day the intermediate trench 22 is dug or excavated, the depth will vary.

After the first pass by the first trencher 14, a second trencher 36 makes a pass along the same predetermined line so that the intermediate trench 22 is dug in to increase the depth from approximately the water table 12 to the completed depth 38 to form a full depth trench 40. However, in making the second pass and digging from the water table 12 to the completed depth 38, wet spoil 42 is created. While the amount of water content and consistency of the wet spoil 42 varies depending upon a number of factors, it is normally very pliable and flowable. The wet spoil 42 is similar in texture to wet concrete with gravel therein.

In making the second pass with the second trencher 36, the digging chain 44 is reversed so that the cutting teeth cut on the way down because the direction of rotation of the digging chain 44 for second trencher 36 is the opposite of the direction of rotation of the digging chain 28 of first trencher 14, both directions being shown with the direction of the arrows. Also, the belt 48 is turned OFF and raised. The wet spoil 42 will tend to be carried upward on the boom 50 where the digging chain 44 is moving upward as is shown in FIG. 1. In this manner, the digging action is as close to the second trencher 36 as is possible. Also, the wet spoil 42 simply falls back into the full depth trench 40. The part of the full depth trench 40 that was the intermediate trench 22 will take care of any expansion of the wet spoil 42 after being dug from below the water table 12 to the completed depth 38 to form the full depth trench 40.

Tracks 52 will control the forward motion of the second trencher 36. It has been found the operation of the second trencher 36 and the rotational speed of the digging chain 44 may have to be adjusted downward to prevent wet spoil 42 from spilling outside of the full depth trench 40. Also, by slowing the speed of the digging chain 40 and forward motion of second trencher 36, the cutting teeth 46 will cut larger size chunks for including in the wet spoil 42. Both the rotational speed of the tracks 52 and the rotational speed of the digging chain 44 control the spillage of wet spoil 42 from the full depth trench 40, plus the size of the rock in the wet spoil 42.

Figure 2B:
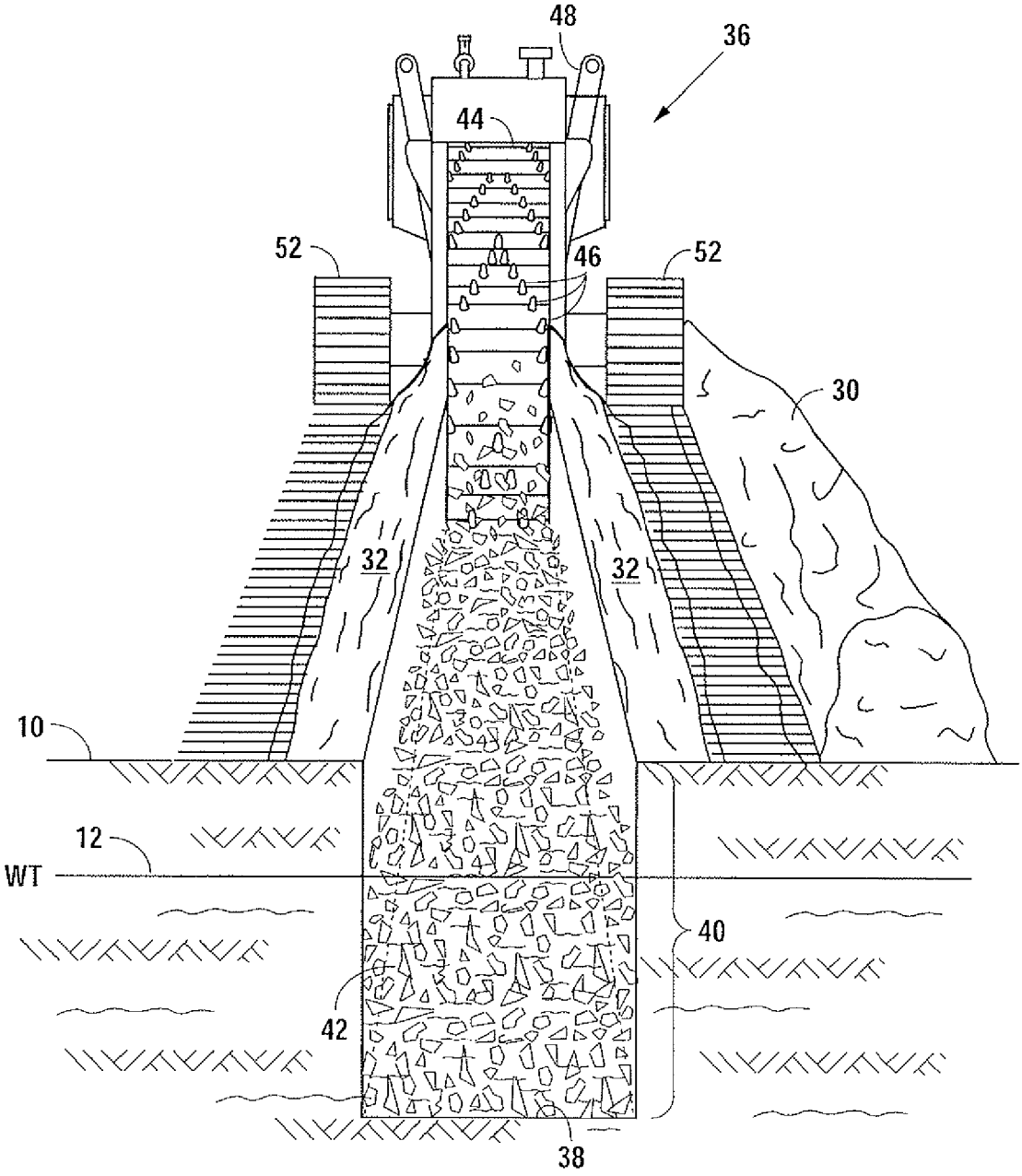
FIG. 2B is a cross-sectional view of FIG. 1 taken along section lines 2B-2B of FIG. 1 illustrating the second pass.

FIG. 2B shows an end view of the second trencher 36 along section lines 2B-2B of FIG. 1. The wet spoil 42 is retained inside of the full depth trench 40 with portions of the relatively dry spoil 26 being shown in mounds 32 and wind row 30. The full depth trench 40 is dug from the surface 10 through the water table 12 to completed depth 38. The digging chain 44 with the cutting teeth 46 will tend to drag the wet spoil 42 upwards, which wet spoil 42 will fall back into the full depth trench 40 due to gravity.

Figure 3A:
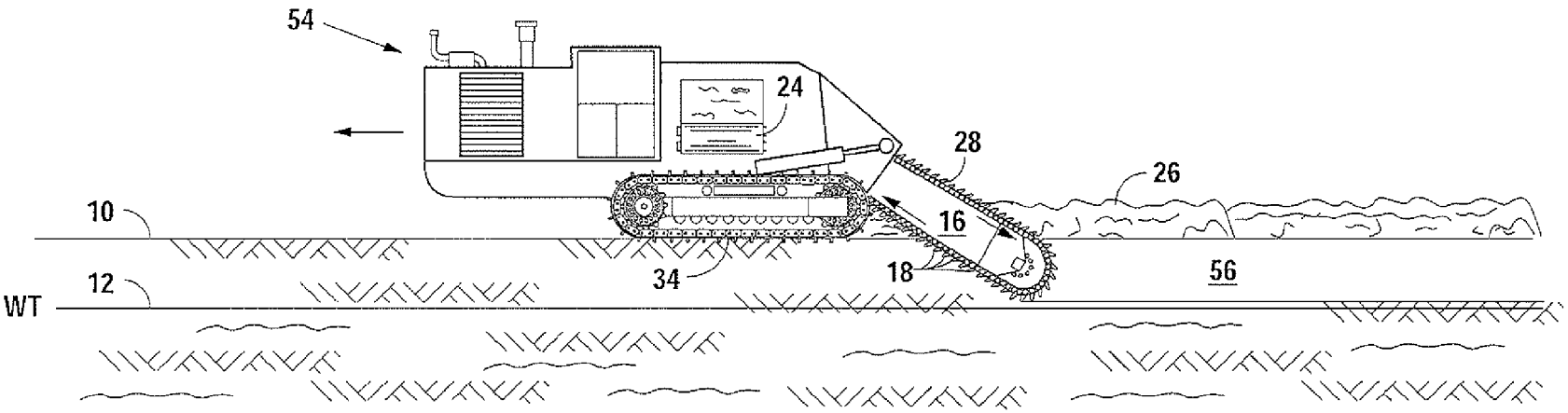
FIGS. 3A and 3B are sequential side elevated views of a trench being dug in the earth's surface to illustrate an alternative embodiment of the second pass.
Figure 3B:
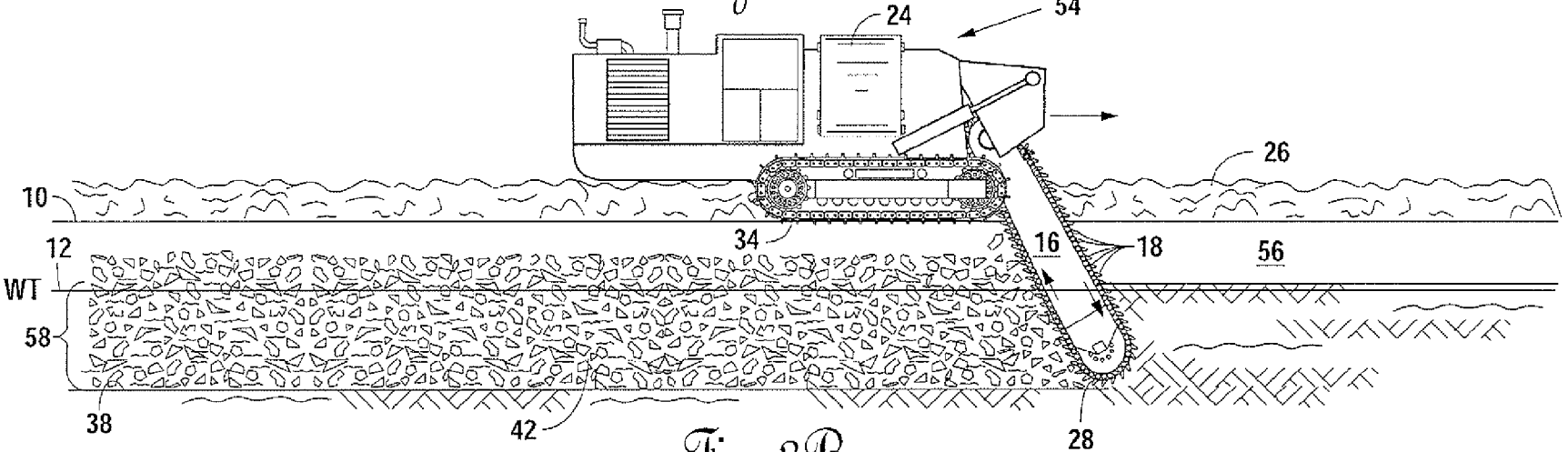

Referring now to FIGS. 3A and 3B, an alternative method of digging a trench below the water table 12 is shown. The trencher 54 is identical to the first trencher 14 with a boom 16, digging chain 28, cutting teeth 18 and belt 24. The trencher 54 operates on tracks 34, the same as first trencher 14. Trencher 54 digs and excavates from the surface 10 to approximately the water table 12 in a first pass to form a first trench 56 therein. The relatively dry spoil 26 is excavated out of the first trench 56 into either a wind row 30 or mounds 32 as shown in conjunction with FIG. 2A. The trencher 54 is moving in the direction indicated by the arrow along a predetermined line where a trench is to be dug. The digging chain 28 is rotating in the direction indicated by the arrows in FIG. 3A.

After completing the first pass as shown in FIG. 3A, the same trencher 54 has the belt 24 raised, the boom 16 lowered and is operated in the opposite direction as indicated by the direction of the arrow. The digging chain 28 is rotating in the same clockwise manner in FIG. 3B as in FIG. 3A. The trencher 54 digs a second trench 58 below the first trench 56, which second trench 58 is dug from approximately the water table 12 to the completed depth 38. Because the belt 24 is turned OFF and raised, the wet spoil 42 falls back into the combined first trench 56 and second trench 58. Due to the combination of the first trench 56 and second trench 58, expansion of the wet spoil 42 is accommodated without spillage outside of the combined trenches.

One of the problems with the second pass as shown in FIG. 3B, is that the cutting by the cutting teeth 18 on the digging chain 28 is on the far end of the boom 16. This can cause vibrations along the boom back to the trencher 54. Also, the speed of the tracks 34 and the cutting chain 28 will have to be adjusted to accommodate the backward digging of the trencher 54 as shown in FIG. 3B. Normally the rotational speed of the tracks 34 and the digging chain 28 will have to be reduced for the second pass as shown in FIG. 3B.

Figure 4B:
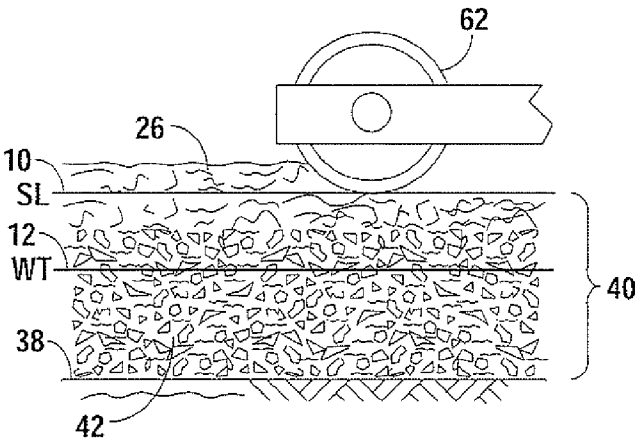
FIGS. 4A, 4B, 4C, 4D and 4E are sequential views showing a method of completion of a trench dug according to the present invention.

If the methods as shown either in FIG. 1 or FIGS. 3A and 3B are followed, a trench can be dug below the water table in an environmentally sensitive area such as the Florida Keys without spillage of wet spoil 42 outside of the full depth trench 40. However, normally there is a requirement to use a road surface if the full depth trench 40 is being dug in a road, before the item going in to the trench (such as electrical cables, water pipe or sewer lines) are ready to install. It may be weeks or even months later before installation occurs inside the full depth trench 40. Therefore, referring to FIGS. 4A-4E respectively, a sequence of steps is shown so that the surface 10 can be used before completing installation in the full depth trench 40. The relatively dry spoil 26 may be pushed by a scoop 60 attached to a suitable tractor (not shown) into full depth trench 40. The scoop 60 moves the relatively dry spoil 26 on top of the wet spoil 42 in the full depth trench 40 (see FIG. 4A). Thereafter, the relatively dry spoil 26 and the wet spoil 42 are compacted into the full depth trench 40 by a roller/compactor 62 (see FIG. 4B). After the relatively dry spoil 26 and the wet spoil 42 have been compacted into the full depth trench 40, the surface 10 may again be used by traffic or other types of designated use.

Figure 4E:
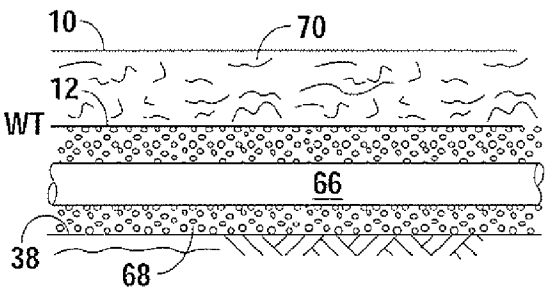
Figure 4A:
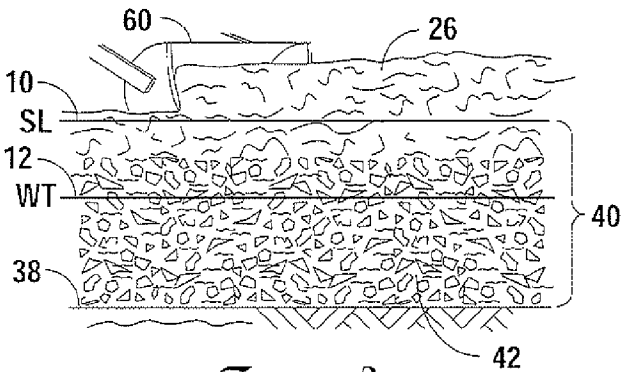
Figure 4D:
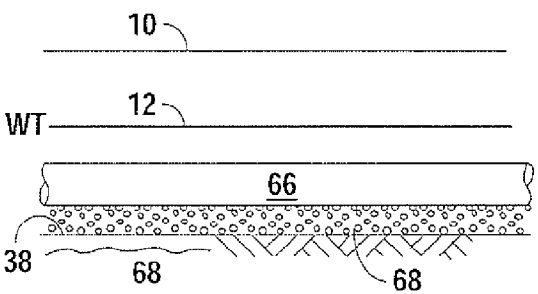
Figure 4C:
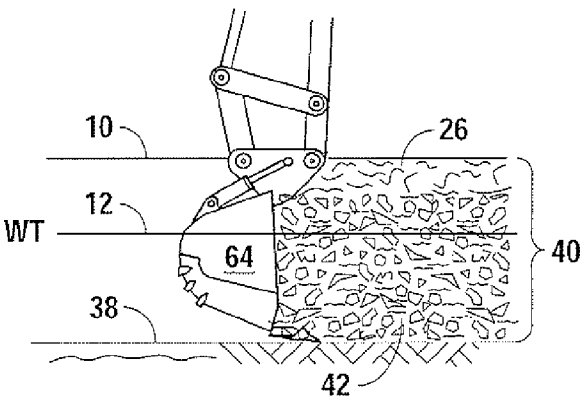

Months later when the decision is made to lay, for example, a sewer line in the full depth trench 40, a backhoe 64 may be used to excavate the relatively dry spoil 26 and the wet spoil 42 from the full depth trench 40 (see FIG. 4C). The combined relatively dry spoil 26 and the wet spoil 42 may be loaded into a truck and hauled away. Assuming a sewer line 66 is installed as shown in FIG. 4D, first a bed of gravel 68 or other suitable material is placed in the bottom of the full depth trench 40 (see FIG. 4D). Thereafter, the sewer line 66 is laid thereon. Next, the sewer line 66 is covered with more gravel 68 and other suitable surface material 70 is applied above the gravel 68. The suitable surface material 70 may be pavement, concrete or even part of the removed spoil, depending upon the circumstances. Thereafter, the surface 10 as shown in FIG. 4E is complete and can be utilized for its normal purpose.

By use of the methods just described, a trench can be dug or excavated below the water table in an environmentally sensitive area such as the Florida Keys. The relatively dry spoil 26 can be easily controlled and scooped up. However, wet spoil 42 flows everywhere and is almost impossible to remove under normal trenching conditions. By use of the current method, the wet spoil 42 is retained inside of the trench until it is excavated with a backhole 64 and carried away. This prevents the spoil from contaminating the environment therearound, especially in environmentally sensitive areas like the Florida Keys.

Figure 5A:
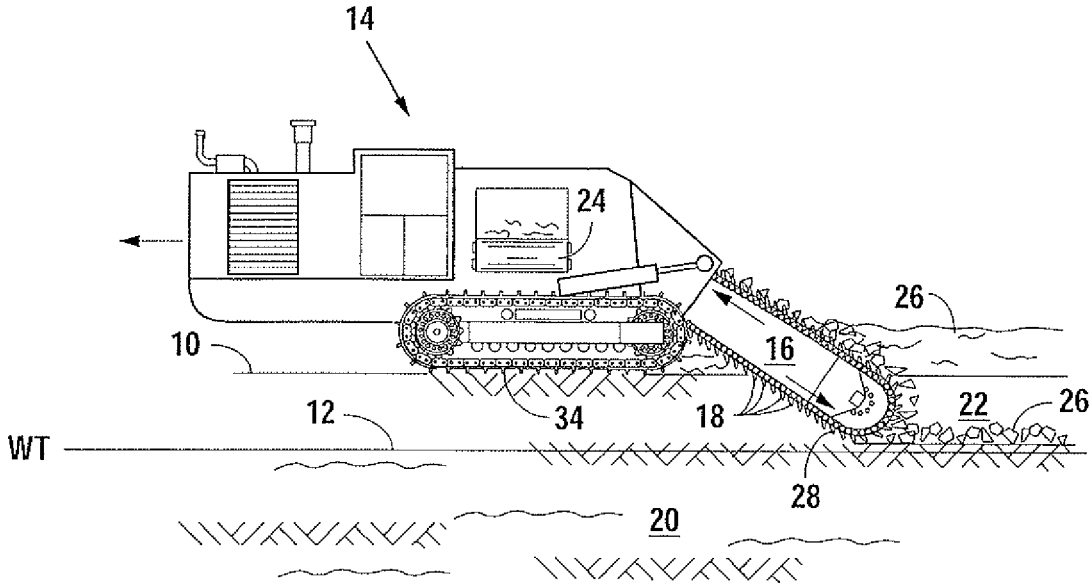
FIG. 5A is an elevated pictorial view illustrating trenching at a first depth.
Figure 5B:
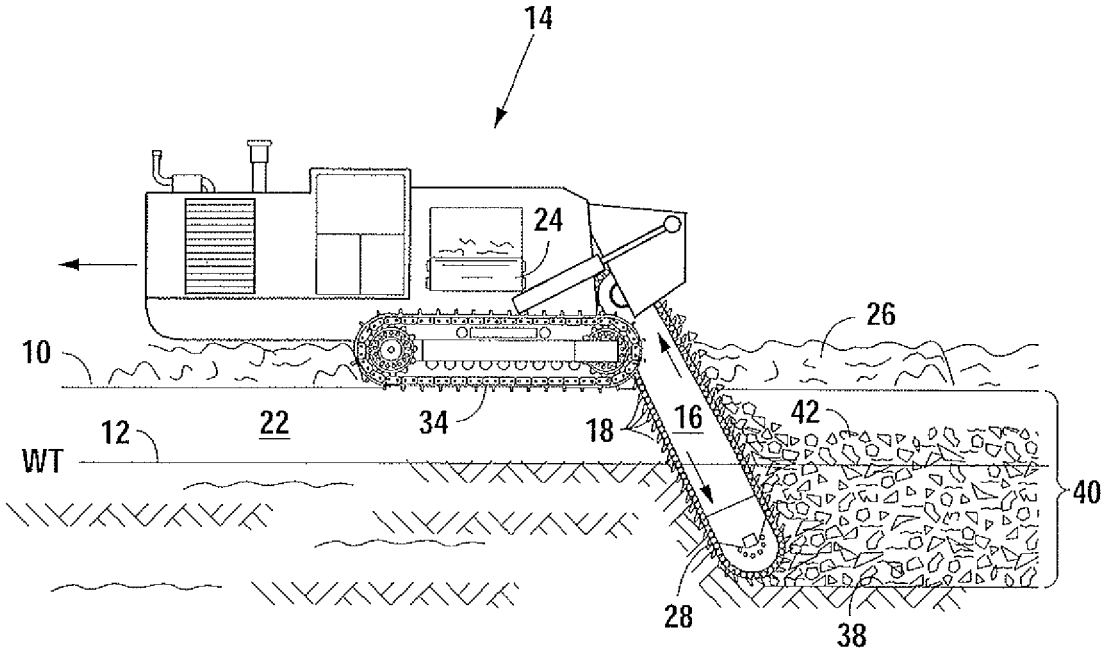
FIG. 5B is an elevated pictorial view illustrating trenching at a second depth.

A third method of digging or excavation of a trench in an environmentally sensitive area is illustrated in FIGS. 5A and 5B. Referring to FIG. 5A, the trencher 14 is identical to the first trencher 14 shown in FIG. 1; however, the digging chain 28 has been reversed and the direction of rotation thereof as indicated by the arrows has been reversed. The digging chain 28 now has the cutting teeth 18 digging the intermediate trench 22 during the first pass. Some of the relatively dry spoil 26 rides up the outside of the digging chain 28 and is deposited on the belt 24. The relatively dry spoil 26 on the belt 24 is moved to the side into wind rows 30 (see FIG. 2A); however, some of the relatively dry spoil 26 will remain in intermediate trench 22 or on the banks thereof.

The same trencher 14 can be used for a second pass as illustrated in FIG. 5B; however, the belt 24 will need to be turned OFF. During the second pass, the trencher 14 will dig from the water table 12 to the completed depth 38. Because the belt 24 is turned OFF, all of the wet spoil 42 being dug, along with any remainder of dry spoil 26 that is in the intermediate trench 22, will fall into the full depth trench 40 as shown. The digging by teeth 18 is on the downward part of the counter clockwise rotation as shown in the arrows of FIG. 5B. In both FIGS. 5A and 5B, the digging chain 28 is rotating in a counter clockwise direction and the digging is on the downward rotation by the digging teeth 18.

The rotational speed of the tracks 34 and digging chain 28 may have to be adjusted in FIG. 5B to retain the combination of wet and dry spoil in the full depth trench 40.

After digging of the full depth trench 40 as explained in conjunction with FIGS. 5A and 5B, the sequential steps as explained in conjunction with FIGS. 4A-4E may be utilized.

I claim:

1. A method for trenching below the water table in an environmentally sensitive area for placement of electric cables, water pipes, or sewer lines therein, the method using a trenching machine having a boom with a digging chain thereon, belt for moving spoil to one side, and tracks to move the trenching machine, said method including the following steps:

making a first pass with said trenching machine wherein said boom is lowered and a first trench is dug with said digging chain from the surface to the water table, speed of said trenching machine being controlled by speed of said tracks and speed of said digging chain;

simultaneously removing relatively dry spoil from said first trench;

making a second pass in said first trench with said trenching machine with said boom lowered below said water table wherein a second trench is dug with said digging chain immediately below said first trench, a combined first and second trench retaining wet spoil therein;

adjusting speed of said digging chain and said tracks during said second pass to allow said digging chain to dig effectively below said water table and prevent spillage;

replacing said relatively dry spoil in said combined first and second trench;

packing said relatively dry spoil and said wet spoil in said combined first and second trench;

redigging packed soil from said combined first and second trench;

placing said electric cables, water pipes, or sewer lines in said combined first and second trench; and refilling said combined first and second trench with suitable fill material.

2. The method of trenching below the water table as recited in claim 1 wherein two trenching machines are used, a first trenching machine making said first pass and a second trenching machine making said second pass, said second trenching machine going in the same direction as said first trenching machine, however, said digging chain on said second trenching machine being reversed and said belt raised to cause said wet spoil to be retained in said combined first and second trench.

3. The method of trenching below the water table as recited in claim 2 wherein said adjusting step includes decreasing speed of said digging chain to prevent spillage of said wet spoil.

4. The method of trenching below the water table as recited in claim 1 wherein said second pass is by said trenching machine operating in reverse and with said belt raised to cause said wet spoil to be retained in said combined first and second trench.

5. The method of trenching below the water table as recited in claim 1 including a step of removing excess spoil.

6. The method of trenching below the water table as recited in claim 1 wherein said digging chain rotates in a counterclockwise direction, said belt for moving spoil being ON during said first pass and OFF during said second pass.

7. A method for trenching along a predetermined line below the water table in a porous crust of the earth with a trenching apparatus having a boom with a digging chain rotatably connected thereon, said method comprising the following steps:

locating said trenching apparatus along said predetermined line;

making a first pass with said trenching apparatus along said predetermined line to dig an intermediate depth trench with said digging chain, said boom being lowered so that said intermediate depth trench is dug from the surface to the water table;

removing relatively dry spoil from said intermediate depth trench during said first pass;

making a second pass in said intermediate depth trench with said trenching apparatus along said predetermined line to dig a completed depth trench with said digging chain, said boom being lowered further so that said completed depth trench is dug from the water table to the completed depth;

retaining wet spoil from said second pass in said completed depth trench;

adjusting speed of said trenching apparatus and said digging chain during said second pass to prevent spillage of said wet spoil from said completed depth trench;

filling said completed depth trench with said relatively dry spoil and compacting said relatively dry spoil and said wet spoil in said completed depth trench; and redigging compacted spoil from said competed depth trench, laying an item to be buried therein, burying the item and refilling said completed depth trench with suitable fill material.

8. The method of trenching along a predetermined line below the water table in a porous crust of the earth as recited in claim 7 wherein said first pass is in a first direction and said second pass is in an opposite direction.

9. The method of trenching along a predetermined line below the water table in a porous crust of the earth as recited in claim 8 wherein before said second pass a belt to remove relatively dry spoil is turned OFF and raised.

10. The method of trenching along a predetermined line below the water table in a porous crust of the earth as recited in claim 7 including removing excess redug spoil.

11. The method of trenching along a predetermined line below the water table in a porous crust of the earth as recited in claim 7 wherein said digging chain operated in a counterclockwise direction.

12. The method of trenching along a predetermined line below the water table in a porous crust of the earth as recited in claim 11 where a belt to remove relatively dry spoil during said first pass is turned OFF during said second pass.

* * * * *